US009482457B2

(12) United States Patent
Sung

(10) Patent No.: US 9,482,457 B2
(45) Date of Patent: Nov. 1, 2016

(54) ICE SHAVING MACHINE

(71) Applicants: Global Bear Corp., Taichung (TW); Kun-Wei Sung, Taichung (TW)

(72) Inventor: Kun-Wei Sung, Taichung (TW)

(73) Assignees: Global Bear Corp., Taichung (TW); Kun-Wei Sung, Taichung (TW)

( * ) Notice: Subject to any disclaimer, the term of this patent is extended or adjusted under 35 U.S.C. 154(b) by 330 days.

(21) Appl. No.: 14/284,506

(22) Filed: May 22, 2014

(65) Prior Publication Data

US 2015/0338148 A1 Nov. 26, 2015

(51) Int. Cl.
*B02C 18/22* (2006.01)
*F25C 5/12* (2006.01)

(52) U.S. Cl.
CPC ..... *F25C 5/12* (2013.01); *B02C 18/2225* (2013.01)

(58) Field of Classification Search
CPC ..... F25C 5/12; B02C 18/2225; B02C 18/22
USPC ..... 241/DIG. 17
See application file for complete search history.

(56) References Cited

U.S. PATENT DOCUMENTS 4,718,610 A * 1/1988 Gallaher ..... A23G 9/045 241/101.2
2002/0053616 A1* 5/2002 Rupp ..... A23G 9/045 241/291

* cited by examiner

*Primary Examiner* — Mark Rosenbaum
(74) *Attorney, Agent, or Firm* — Alan D. Kamrath; Kamrath IP Lawfirm, P.A.

(57) ABSTRACT

An ice shaving machine includes a base, a main body mounted on the base and having a platform provided with a shaving blade, a limit module mounted on the platform, and a rotation disk mounted in the main body. The limit module has an inner periphery provided with a receiving space. Thus, the ice block is limited by the limit module so that the ice block will not produce vibration during rotation to keep the stability and safety of the ice shaving machine during operation. In addition, the limit module has a central point the same as that of the platform so that when the ice block is received in the receiving space of the limit module and is shaved by the shaving blade, the force from the ice block is distributed evenly and smoothly on the shaving blade.

8 Claims, 9 Drawing Sheets

ICE SHAVING MACHINE

BACKGROUND OF THE INVENTION

1. Field of the Invention

The present invention relates to a shaving machine and, more particularly, to an ice shaving machine for shaving an ice block into a lot of ice slices or chips.

2. Description of the Related Art

A conventional ice shaving machine 1 in accordance with the prior art shown in FIGS. 8 and 9 comprises a recessed base 12, a main body 11 mounted on the top of the base 12 and having a platform 13 provided with a slotted shaving blade 16, a rotation disk 14 rotatably and movably mounted in the main body 11, a handle 17 swivelably mounted on the main body 11 and connected with the rotation disk 14, and a placement dish mounted in the base 12 and located under the shaving blade 16 of the main body 11. When the conventional ice shaving machine 1 is in use, an ice block 15 is initially received in the main body 11 and placed on the platform 13 of the main body 11. Then, the handle 17 is revolved to drive the rotation disk 14 so that the rotation disk 14 is moved downward to press the ice block 15. Then, the rotation disk 14 is driven and rotated by a driving motor (not shown) to rotate the ice block 15 so that the ice block 15 is turned by the rotation disk 14 and shaved by the shaving blade 16 to form a lot of ice chips which are extended through the shaving blade 16 and are injected toward the placement dish.

However, the main body 11 easily produces vibration when the ice block 15 deviates the central position of the platform 13 of the main body 11, thereby affecting operation of the rotation disk 14. In addition, the shaving blade 16 is subjected to an unevenly distributed force when the ice block 15 deviates the central position of the platform 13 of the main body 11, thereby decreasing the lifetime of the shaving blade 16.

BRIEF SUMMARY OF THE INVENTION

In accordance with the present invention, there is provided an ice shaving machine comprising a base, a main body mounted on the base and having a platform provided with a shaving blade, a limit module mounted on the platform, and a rotation disk mounted in the main body. The limit module has an inner periphery provided with a receiving space.

The platform is provided with a plurality of through holes. The limit module includes a plurality of limiting members mounted in the through holes of the platform. The receiving space of the limit module is defined between the inner edges of the limiting members. The through holes of the platform are arranged in a circular manner and have a central point the same as that of the platform. Preferably, the platform has at least three through holes. Preferably, the limit module includes at least three limiting members. Each of the limiting members of the limit module has a bottom provided with a mounting portion inserted into one of the through holes of the platform. The mounting portion of each of the limiting members has a bottom provided with a threaded section, and the limit module further includes a plurality of nuts each screwed onto the threaded section of one of the limiting members and each abutting a bottom of the platform to lock the limiting members onto the platform. Alternatively, the platform is provided with multiple sets of through holes which are extended radially in a radiating manner. The multiple sets of through holes of the platform are arranged concentrically and have a central point the same as that of the platform. The multiple sets of through holes of the platform have different diameter to define the receiving space of the limit module with different dimensions. Alternatively, the limit module includes an annular limiting member mounted on the platform. The limit module is formed integrally on the platform. Alternatively, the limit module is preferably mounted on the platform by soldering. The limit module has a central point the same as that of the platform.

According to the primary advantage of the present invention, the ice block that is rotating is limited by the limit module so that the ice block will not produce vibration during rotation to keep the stability and safety of the ice shaving machine during operation.

According to another advantage of the present invention, the limit module has a central point the same as that of the platform so that when the ice block is received in the receiving space of the limit module and is shaved by the shaving blade, the force from the ice block is distributed evenly and smoothly on the shaving blade to prevent the shaving blade from being worn out due to a stress concentration, thereby enhancing the lifetime of the shaving blade.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
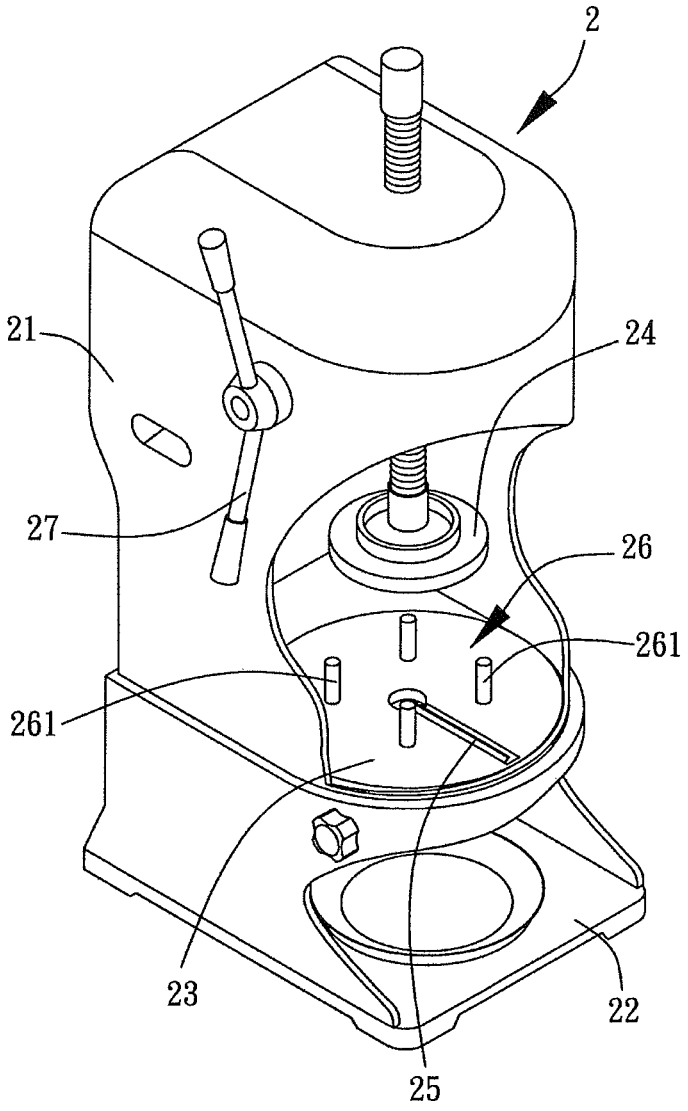
FIG. 1 is a perspective view of an ice shaving machine in accordance with the preferred embodiment of the present invention.
Figure 2:
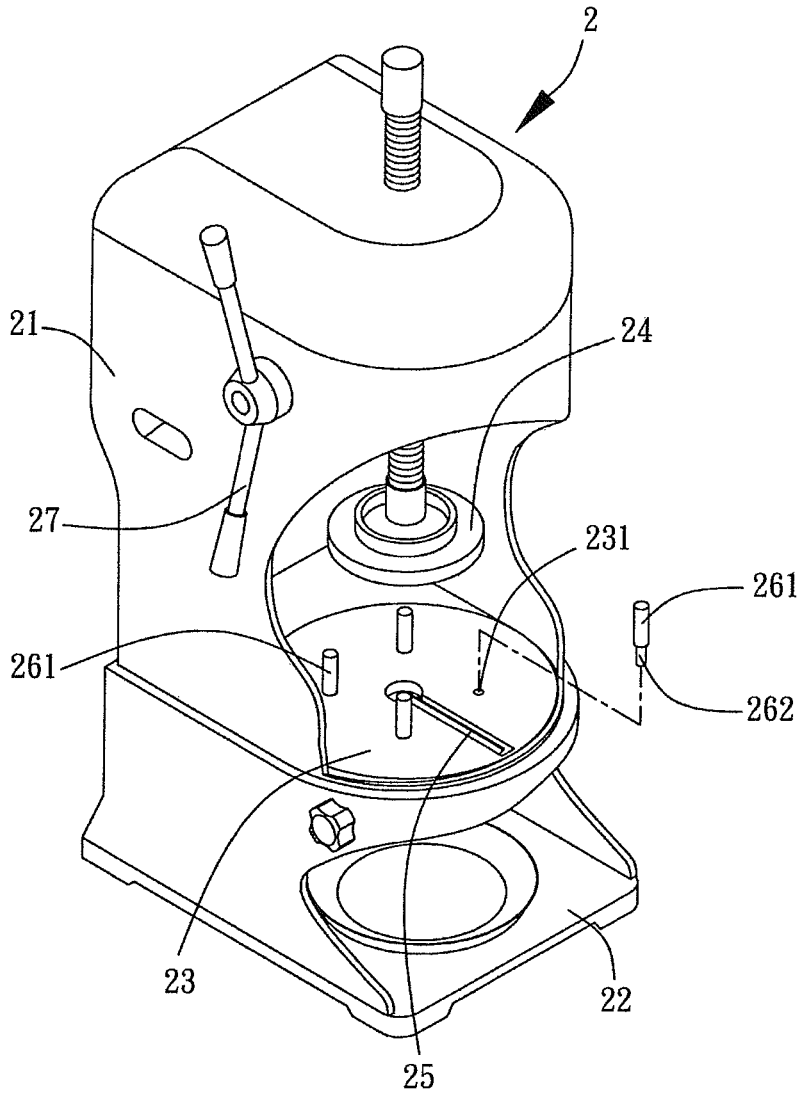
FIG. 2 is a partially exploded perspective view of the ice shaving machine as shown in FIG. 1.
Figure 3:
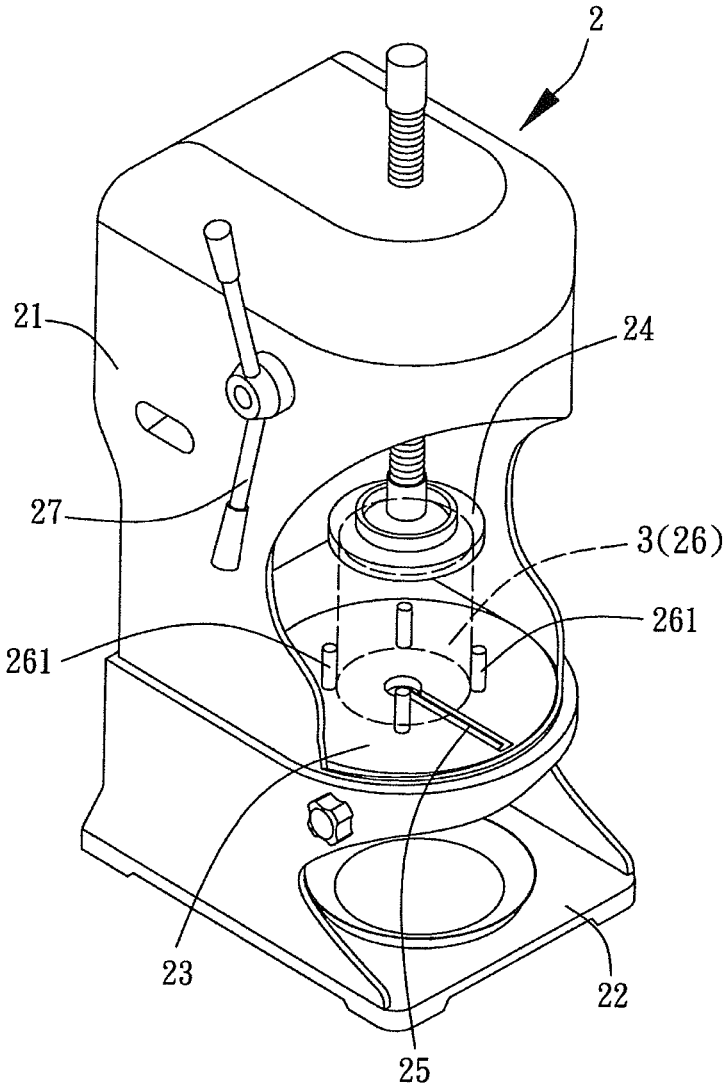
FIG. 3 is a schematic operational view of the ice shaving machine as shown in FIG. 1 in use.

Referring to the drawings and initially to FIGS. 1-3, an ice shaving machine 2 in accordance with the preferred embodiment of the present invention comprises a recessed base 22, a hollow main body 21 mounted on a top of the base 22 and having a platform 23 provided with a slotted shaving blade 25, a limit module 26 mounted on the platform 23, a rotation disk 24 rotatably and movably mounted in the main body 21, a handle 27 swivelably mounted on the main body 21 and connected with the rotation disk 24, and a placement dish (not labeled) mounted in the base 22 and located under the shaving blade 25 of the main body 21.

The platform 23 is provided with a plurality of through holes 231. The through holes 231 of the platform 23 are arranged in a circular manner and have a central point the same as that of the platform 23. Preferably, the platform 23 has at least three through holes 231.

The limit module 26 is preferably mounted on the platform 23 by soldering. Alternatively, the limit module 26 is formed integrally on the platform 23. The limit module 26 has a central point the same as that of the platform 23 and has an inner periphery provided with a receiving space. The limit module 26 includes a plurality of limiting members 261 mounted in the through holes 231 of the platform 23. The receiving space of the limit module 26 is defined between the inner edges of the limiting members 261. Preferably, the limit module 26 includes at least three limiting members 261. Each of the limiting members 261 of the limit module 26 has a bottom provided with a mounting portion 262 inserted into one of the through holes 231 of the platform 23.

In operation, referring to FIG. 3 with reference to FIGS. 1 and 2, an ice block 3 with a diameter equal to or smaller than the dimension of the receiving space of the limit module 26 is initially received in the main body 21 and placed on the platform 23 of the main body 21. At this time, the ice block 3 is kept in the receiving space of the limit module 26 and limited between the limiting members 261 of the limit module 26 as shown in FIG. 3. Then, the handle 27 is revolved to drive the rotation disk 24 so that the rotation disk 24 is moved downward to press the ice block 3 which is clamped between the rotation disk 24 and the platform 23 of the main body 21. Then, the rotation disk 24 is driven and rotated by a driving motor (not shown) to rotate the ice block 3 so that the ice block 3 is turned by the rotation disk 24 and shaved by the shaving blade 25 to form a lot of ice chips which are extended through the shaving blade 25 and are injected toward the placement dish.

Accordingly, the ice block 3 that is rotating is limited by the limit module 26 so that the ice block 3 will not produce vibration during rotation to keep the stability and safety of the ice shaving machine 2 during operation. In addition, the limit module 26 has a central point the same as that of the platform 23 so that when the ice block 3 is received in the receiving space of the limit module 26 and is shaved by the shaving blade 25, the force from the ice block 3 is distributed evenly and smoothly on the shaving blade 25 to prevent the shaving blade 25 from being worn out due to a stress concentration, thereby enhancing the lifetime of the shaving blade 25.

Figure 4:
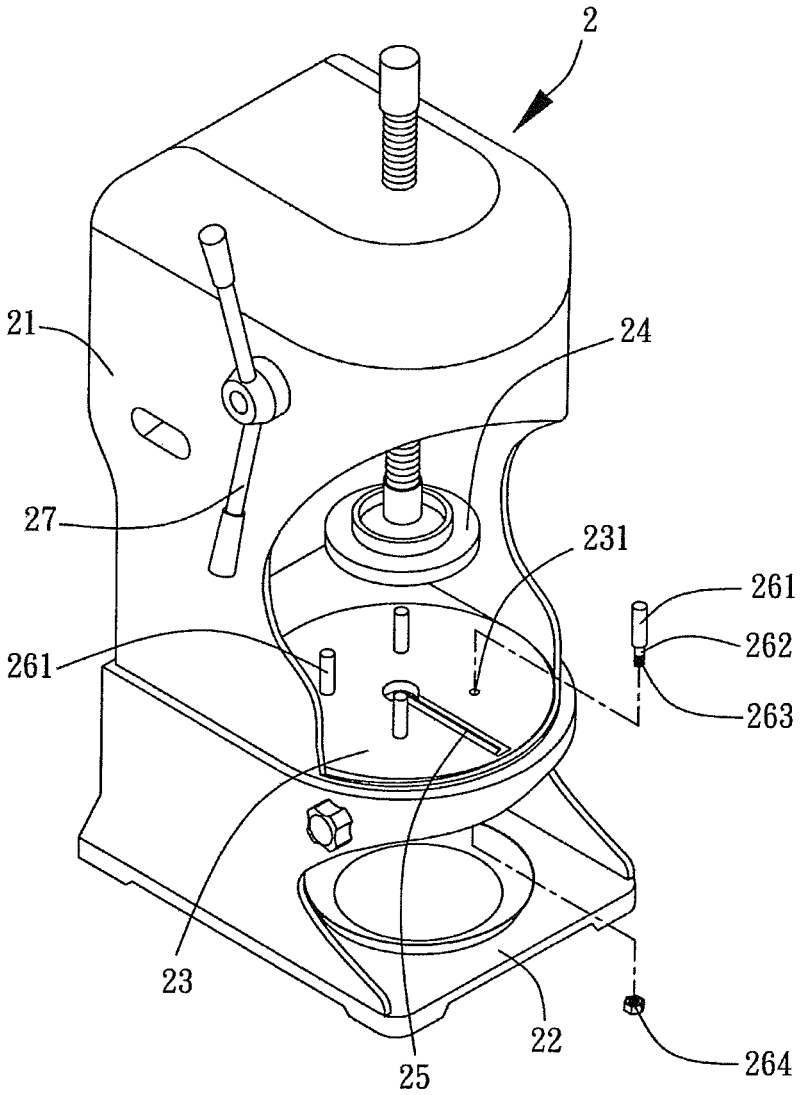
FIG. 4 is a partially exploded perspective view of an ice shaving machine in accordance with another preferred embodiment of the present invention.

Referring to FIG. 4, the mounting portion 262 of each of the limiting members 261 has a bottom provided with a threaded section 263, and the limit module 26 further includes a plurality of nuts 264 each screwed onto the threaded section 263 of one of the limiting members 261 and each abutting a bottom of the platform 23 to lock the limiting members 261 onto the platform 23.

Figure 5:
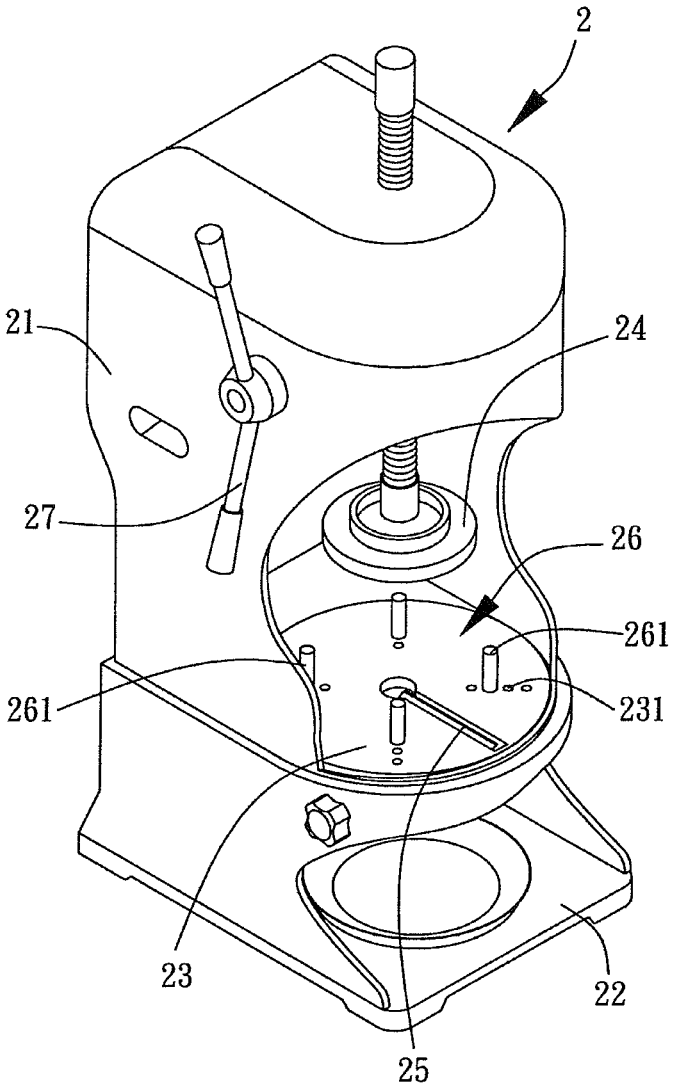
FIG. 5 is a perspective view of an ice shaving machine in accordance with another preferred embodiment of the present invention.
Figure 6:
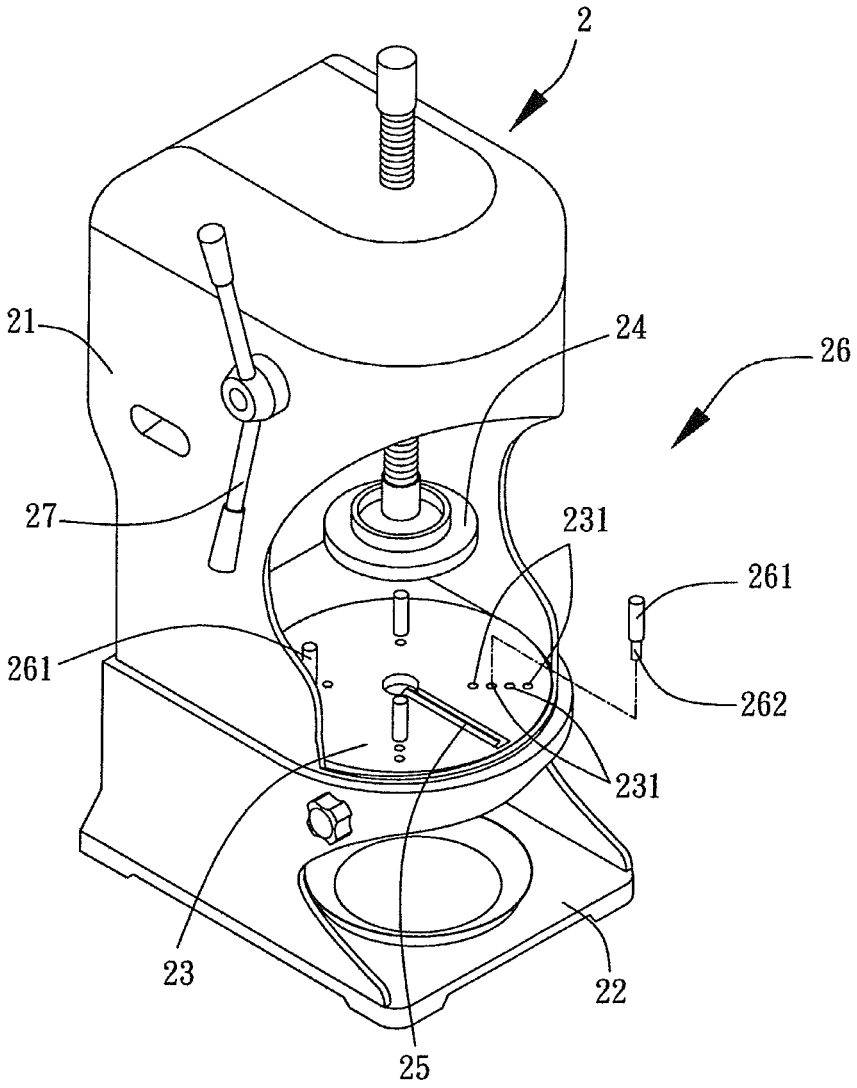
FIG. 6 is a partially exploded perspective view of the ice shaving machine as shown in FIG. 5.

Referring to FIGS. 5 and 6, the platform 23 is provided with multiple sets of through holes 231 which are extended radially in a radiating manner. The multiple sets of through holes 231 of the platform 23 are arranged concentrically and have a central point the same as that of the platform 23. The multiple sets of through holes 231 of the platform 23 have different diameter to define the receiving space of the limit module 26 with different dimensions. Thus, the dimension of the receiving space of the limit module 26 is adjusted to fit the diameter of the ice block 3.

Figure 7:
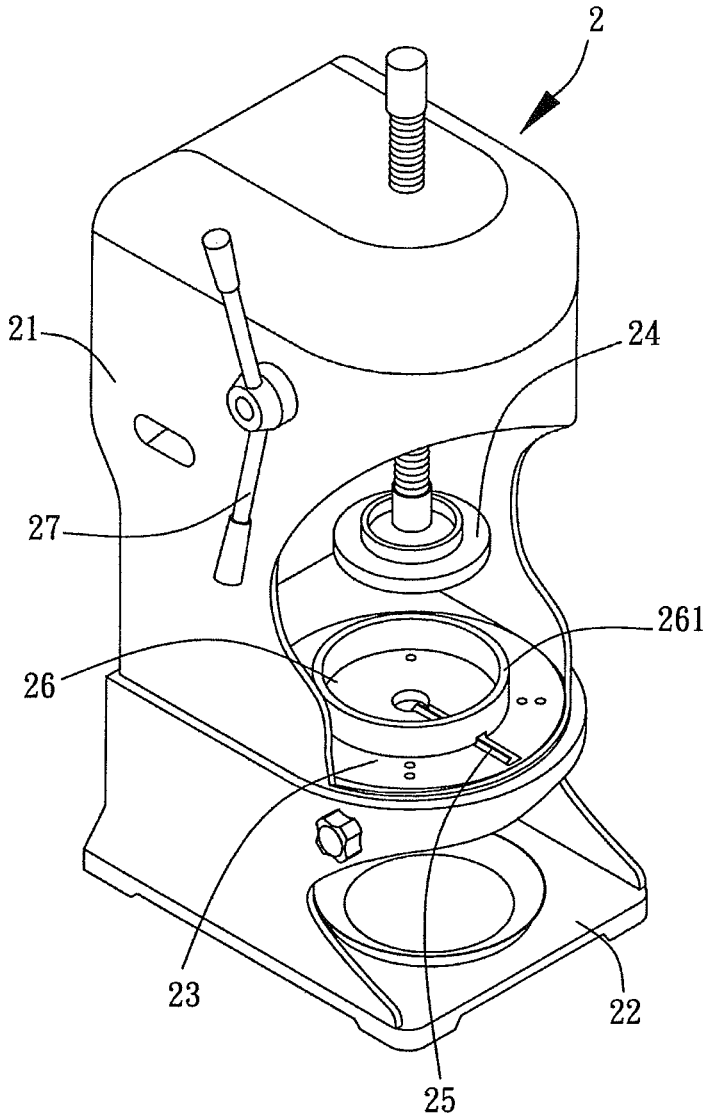
FIG. 7 is a perspective view of an ice shaving machine in accordance with another preferred embodiment of the present invention.
Figure 8:
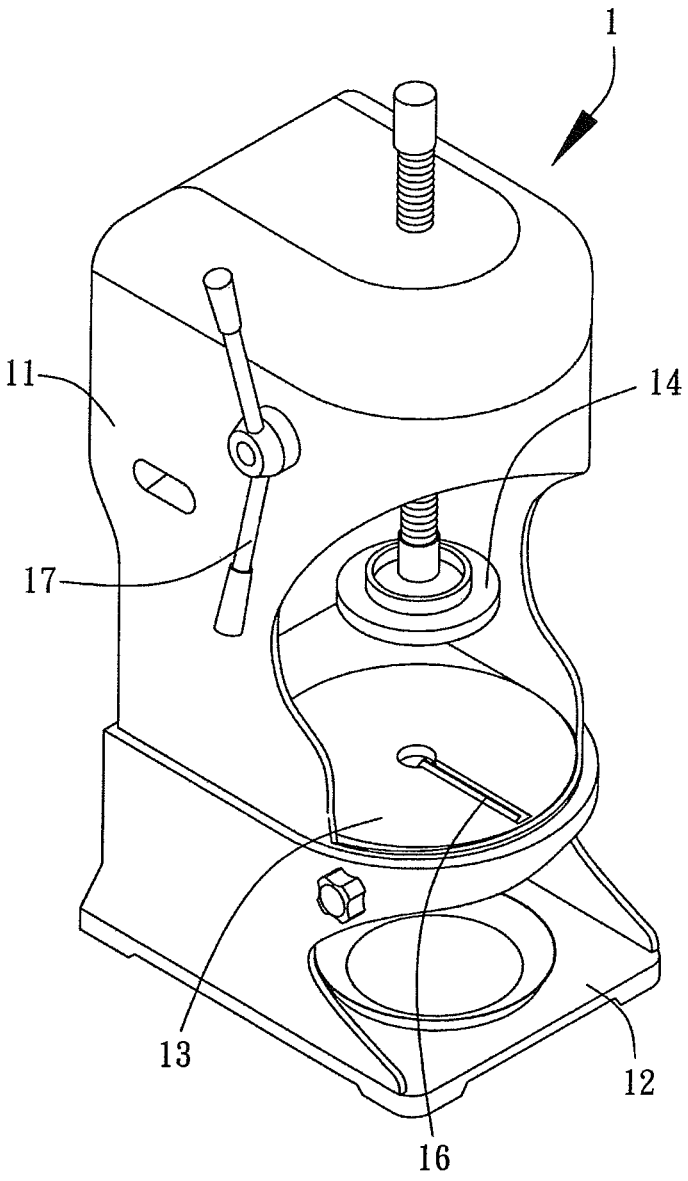
FIG. 8 PRIOR ART
FIG. 8 is a perspective view of a conventional ice shaving machine in accordance with the prior art.
Figure 9:
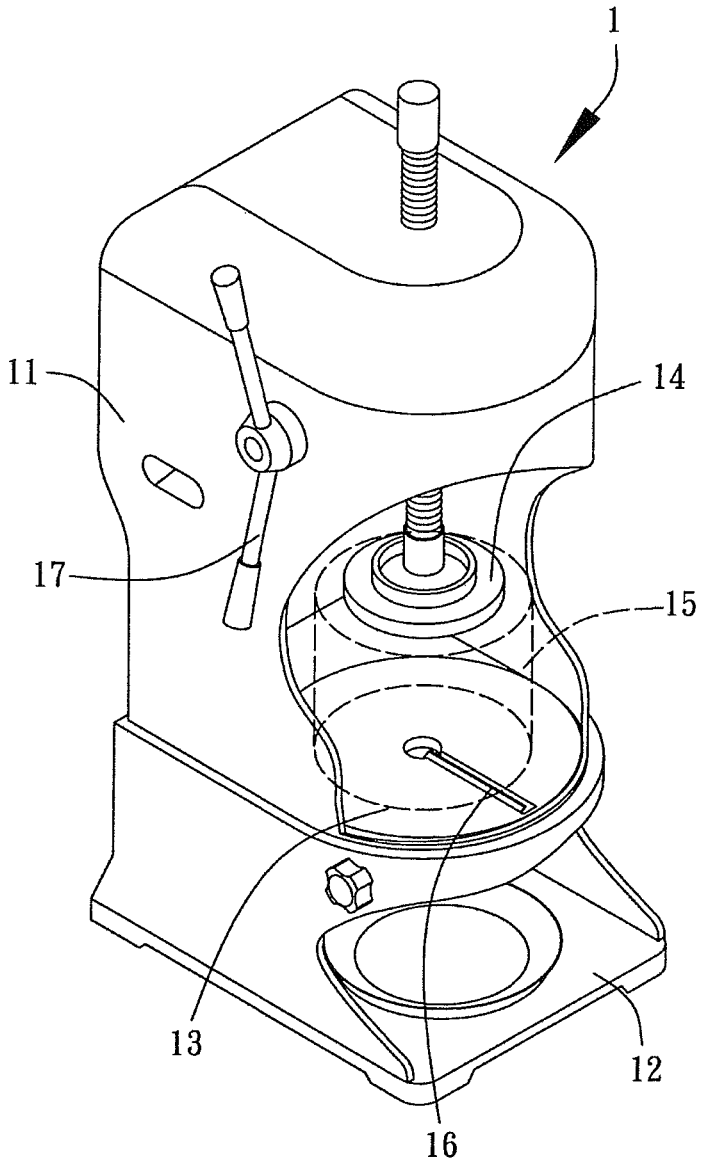
FIG. 9 PRIOR ART
FIG. 9 is a schematic operational view of the conventional ice shaving machine as shown in FIG. 8 in use.

Referring to FIG. 7, the limit module 26 includes an annular limiting member 261 mounted on the platform 23.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An ice shaving machine comprising:

a base;

a main body mounted on the base and having a platform provided with a shaving blade;

a limit module mounted on the platform; and a rotation disk mounted in the main body, wherein:

the limit module has an inner periphery provided with a receiving space;

the platform is provided with multiple sets of through holes which are extended radially in a radiating manner;

the limit module includes a plurality of limiting members mounted in the multiple sets of through holes of the platform;

the receiving space of the limit module is defined between the inner edges of the plurality of limiting members;

the multiple sets of through holes of the platform are arranged concentrically and have a central point the same as that of the platform; and the multiple sets of through holes of the platform have different diameters to define the receiving space of the limit module with different dimensions.

2. The ice shaving machine of claim 1, wherein the multiple sets of through holes of the platform are arranged in a circular manner.

3. The ice shaving machine of claim 1, wherein the limit module includes at least three limiting members.

4. The ice shaving machine of claim 1, wherein each of the plurality of limiting members of the limit module has a bottom provided with a mounting portion inserted into one of the multiple sets of through holes of the platform.

5. The ice shaving machine of claim 4, wherein:

the mounting portion of each of the plurality of limiting members has the bottom provided with a threaded section; and the limit module further includes a plurality of nuts each screwed onto the threaded section of one of the plurality of limiting members and each abutting a bottom of the platform to lock the plurality of limiting members onto the platform.

6. The ice shaving machine of claim 1, wherein the limit module includes an annular limiting member mounted on the platform.

7. The ice shaving machine of claim 1, wherein the limit module is formed integrally on the platform.

8. The ice shaving machine of claim 1, wherein the limit module is mounted on the platform by soldering.

* * * * *